United States Patent [19]

Greune

[11] Patent Number: 4,969,510

[45] Date of Patent: Nov. 13, 1990

[54] HEAT EXCHANGER COMPRISED OF SECTIONS DETACHABLY AND SEALABLY CLAMPED TOGETHER AND ITS METHOD OF ASSEMBLY

[75] Inventor: Christian Greune, Furstenfeldbruck, Fed. Rep. of Germany

[73] Assignee: MTU Motoren -und Turbinen-Union Munchen GmbH, Munich, Fed. Rep. of Germany

[21] Appl. No.: 303,947

[22] Filed: Jan. 30, 1989

[30] Foreign Application Priority Data

Feb. 10, 1988 [DE] Fed. Rep. of Germany ..... 3803948

[51] Int. Cl.[5] ..... F28F 9/02

[52] U.S. Cl. ..... 165/76; 29/890.031; 165/176

[58] Field of Search ..... 165/76, 144, 145, 153, 165/176; 29/157.3 R

[56] References Cited

U.S. PATENT DOCUMENTS

| | | | |
|---|---|---|---|
| 916,640 | 3/1909 | Warg | 165/176 |
| 4,809,774 | 3/1989 | Hagemeister | 165/163 |

FOREIGN PATENT DOCUMENTS

| | | | |
|---|---|---|---|
| 214188 | 10/1909 | Fed. Rep. of Germany | 165/101 |
| 730039 | 12/1942 | Fed. Rep. of Germany | 165/153 |
| 3635548 | 3/1988 | Fed. Rep. of Germany | 165/176 |
| 859510 | 12/1940 | France | 165/153 |
| 134277 | 10/1919 | United Kingdom | 165/153 |

*Primary Examiner*—Martin P. Schwadron
*Assistant Examiner*—Allen J. Flanigan
*Attorney, Agent, or Firm*—Ladas & Parry

[57] ABSTRACT

The air ducts of a heat exchanger are formed of a plurality of duct sections arranged axially one after the other and are clamped together in sealed relation by tension bars arranged symmetrically at the inner surface of the duct sections. The tension bars conform in shape to that of the duct sections to abut thereagainst.

17 Claims, 4 Drawing Sheets

HEAT EXCHANGER COMPRISED OF SECTIONS DETACHABLY AND SEALABLY CLAMPED TOGETHER AND ITS METHOD OF ASSEMBLY

FIELD OF THE INVENTION

The invention relates to a heat exchanger having two substantially parallel manifold ducts to which are connected a plurality of heat exchange tubes arranged in bundles axially of the ducts.

The invention further relates to a method of assembly of such heat exchanger.

BACKGROUND

Heat exchangers of the above type are particularly suitable for operating with gases at high gas temperatures and under rapidly changing thermal conditions. Heretofore, these heat exchanger have been made by rigidly connecting the heat exchange tubes to the manifold ducts by soldering or welding. It is also known to form the ducts of at least two half-shells which are assembled to each other. Alternatively, the ducts can also consist of individual shorter duct sections which are arranged one after the other and soldered together.

Rigid attachment of the parts by soldering or welding has heretofore been considered necessary in order to prevent leakage during operation between the heat-exchanging fluids. This is a real problem due to application of considerable thermal stresses, particularly during non-stationary operation and because of external vibrations and vibrations caused by the flow of gas.

This construction has the disadvantage that, in the case of leaks, which can occur either due to defective manufacture or by fatigue of the material, expensive repairs or even replacement of the entire heat exchanger is frequently necessary.

SUMMARY OF THE INVENTION

An object of the invention is to provide an improved heat exchanger of the aforementioned type which is simple in construction and which permits inexpensive repairs if leaks should occur.

In accordance with the invention, a heat exchanger is provided which comprises two manifold ducts and a plurality of heat exchange tubes connected to the ducts for conveying fluid therebetween; the ducts each include a plurality of duct sections arranged axially one after the other in detachable abutting relation, and tension bars extend within each duct and apply force to the duct sections to press them against one another in sealed relation.

The tension bars are disposed at the inner surface of each duct in a symmetrical arrangement and have a shape in conformance with the shape of the inner surface of the duct.

By forming each manifold duct from a plurality of duct sections arranged one after the other in detachably clamped relation, it is possible in the event of a leak in the heat exchanger to disassemble the latter and replace the defective section. In this way, a considerably more economical manufacture and maintenance of the heat exchanger is possible.

Due to the construction in accordance with the invention, technical simplifications and reductions in cost are obtained for new manufacture as well as for repair of heat exchangers already in operation especially since parts that are still sound can be reused.

Furthermore the inspection of individual heat exchanger sections is considerably simpler than the inspection of a complete heat exchanger. Since the tension bars are arranged within the ducts, substantially no change in the installation dimensions develop as compared to conventional constructions. Furthermore, a reduction in the clamping force will not occur due to thermal expansion caused by the flow of hot gases on the outside of the heat exchanger.

In a preferred embodiment of the invention, the tension bars have a curved cross-sectional shape conforming to the curvature of the duct sections and are disposed against the inner surface of the wall of the duct sections. In this way a symmetrical pre-stress of the duct sections can be obtained, and since the tension bars are approximately at the same temperature as the inner surface of the wall of the duct, differential thermal stresses are low. Furthermore, losses in flow due to structural parts arranged in the inside of the duct is minimized. Two or more tension bars can be symmetrically distributed along the inner surface of the duct sections.

In a feature of the invention, the tension bars are heat insulated from the interior of the duct sections. This is obtained preferably by heat shielding plates and/or heat insulation layers arranged on the tension bars. Thereby, the desired effect of equalized temperature of the duct sections and tension bars is further promoted.

In another feature of the invention, the tension bars are threadably engaged by bolts externally accessible and bearing against one of the end sections of the duct. In this way, an easily detachable clamping engagement of the duct sections is possible.

Preferably, a well-defined initial stress is developed in the tension bars by inserting spacer elements between the end sections of the duct and the ends of the tension bars. In this way, an uncomplicated and reproducibly well-defined clamping of the duct sections of the heat exchanger can be obtained.

DETAILED DESCRIPTION OF A PREFERRED EMBODIMENT

Figure 1:
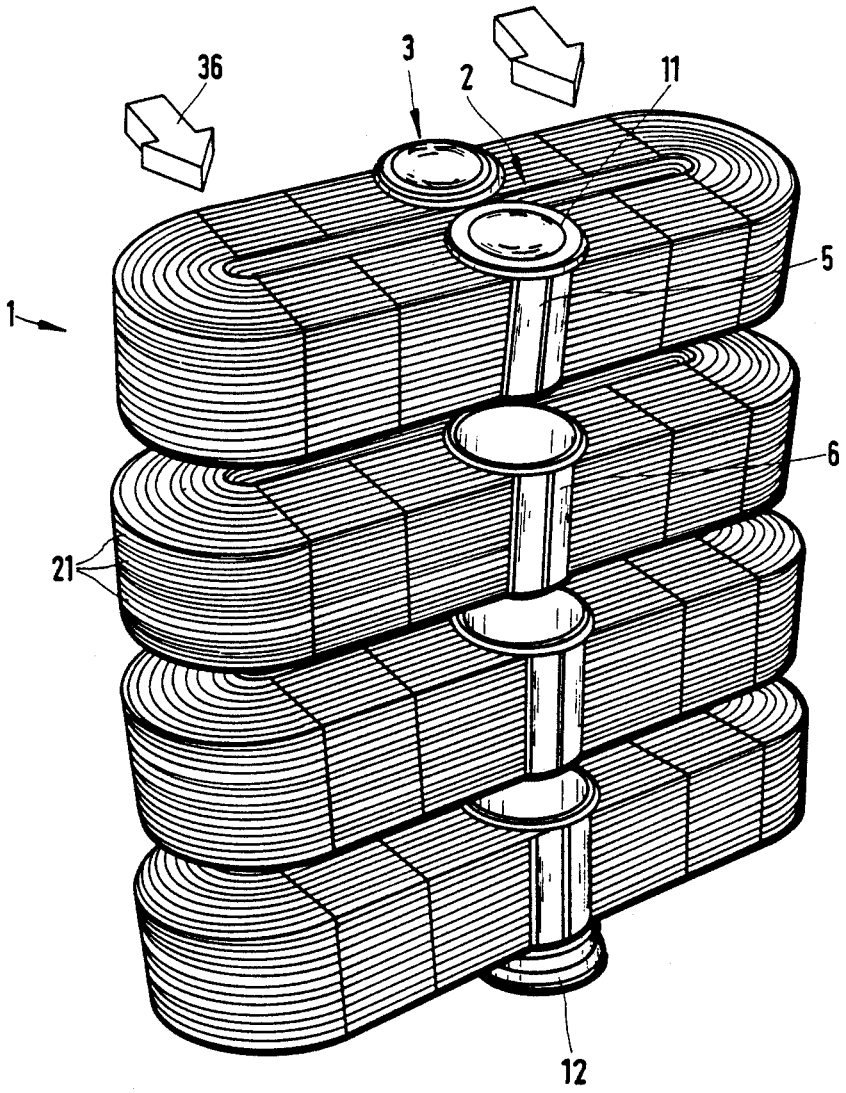
FIG. 1 is a perspective view of the heat exchanger according to the invention in a disassembled state.

FIG. 1 shows a disassembled heat exchanger 1 having manifold ducts 2, 3 respectively comprising a plurality of duct sections 5, 6 arranged axially one after the other. The duct sections 5, 6 are connected together by a plurality of heat exchange tubes 21 of U-shape. The operation of the heat exchanger is as follows. A stream of cool gas axially enters the duct 2. The stream of gas flows through the plurality of heat exchange tubes 21 to duct 3. The gas is heated in the heat exchanger tubes 21 by hot gases flowing outside the tubes in the direction of arrows 36. The heated gases in tubes 21 are combined in duct 3 and flow axially through the duct 3 for external discharge to a suitable utilization means (not shown).

At one end, the duct 2 has an end section 12 through which the incoming stream of cool gas is fed. At the opposite end of the duct 2, a closed end section 11 is provided. The heat exchange tubes 21 are secured to the wall of the duct 2 by soldering or welding.

Figure 2:
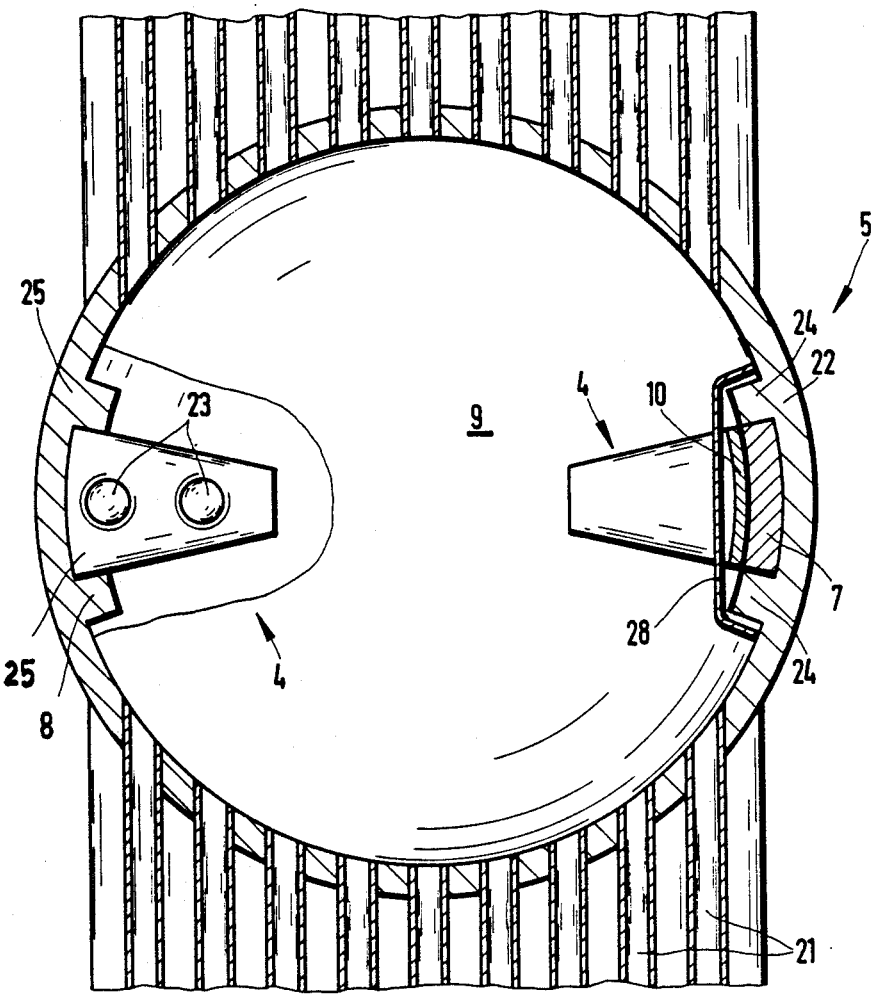
FIG. 2 is a transverse cross-section, partly broken away, through a duct section of the heat exchanger.

FIG. 2 shows tension bars 7 and 8 arranged interiorly at opposite sides of wall 22 of section 5. The tension bar 7 is shown in the plane of the cross-section while the tension bar 8 is seen from its upper end with threaded fastening holes 23 provided thereat for a purpose which will be explained in detail later. Mounted in apertures 35 in the duct wall 22 are the heat exchange tubes 21 by welding or soldering. The heat exchange tubes are oval in cross-section to conform to the shape of the apertures 35. Spaced in the circumferential direction at both sides of the shoulders 24, 25 which embrace the tension bars and prevent lateral movement thereof and turning of the duct sections with respect to each other. The tension bars 7, 8 are covered by heat insulation layer 10 and a shielding plate 28 to shield the bars from the interior 9 of the duct section 5.

In FIG. 2 it is seen that the tension bar 7 bears against the inner surface of the duct wall 22. The guide shoulders 24, 25 are provided in the vicinity of the joints of adjacent duct sections 5, 6 to prevent lateral displacement of the tension bars and of the duct sections 5, 6. In regions 26 (FIG. 3) the tension bars 7 and 8 are formed with parallel side surfaces 27, whereby a simple mounting of the tension bars is made possible. For this purpose, the tension bars 7 and 8 are so fitted that the parallel side surfaces 27 extend to the height of the guide shoulders 24, 25. The tension bars are fitted with angular segments 30 and by shifting the tension bars 7, 8 in the longitudinal direction, segments 30 can be brought into engagement with the guide shoulders 24.

The end region 31 of the tension bar 7 is widened so that tensioning of the tension bar 7 can be obtained by the application of tensile stress to the bar by shoulders 32 on duct section 5 whereby the duct sections 5, 6 are pressed in sealing fashion against each other at joints 29.

Figure 4:
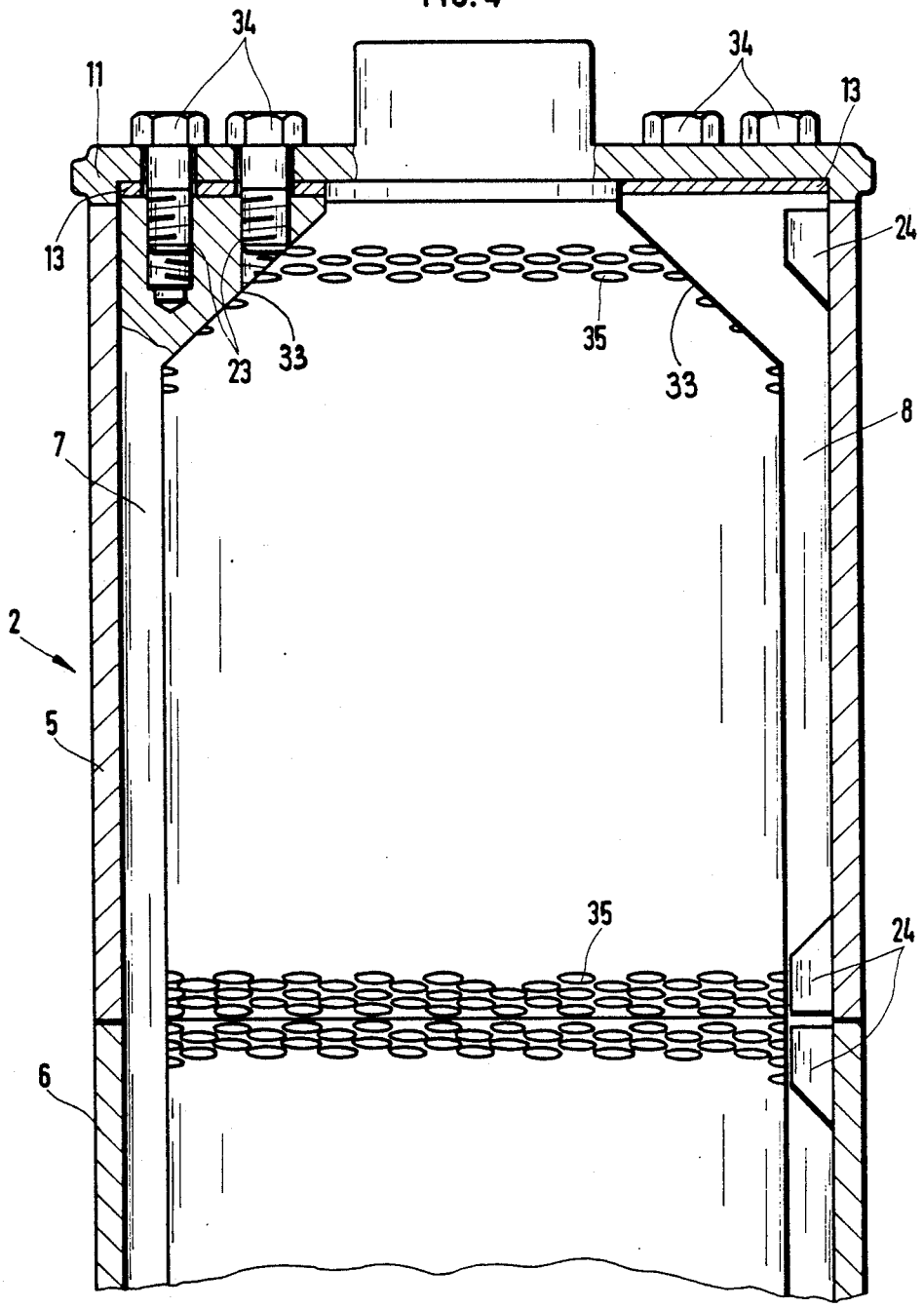
FIG. 4 is an elevational view, partly broken away in section, of the heat exchanger at the top thereof according to a modification.

In the axial section shown in FIG. 4, two duct sections 5 and 6 are seen mounted one after the other and the duct 2 is closed at its upper end by an end section 11. The two opposed tension bars 7 and 8 extend along the inner wall of the duct 2 and at their upper ends adjacent to end section 11 the tension bars 7, 8 are widened at 33 and are provided with the threaded holes 23 therein. The tension bars 7 and 8 are tensioned at end section 11 by bolts 34 threadably engaged in threaded holes 23 and loosely fitted for rotation in end section 11.

In order to obtain a well-defined distributed initial stress, spacer elements 13 are provided between the tension bars 7, 8 and the end section 11. The bolts 34 are loosely fitted in elements 13. The tension bars extend along the inner surface of the duct sections in solid regions thereof devoid of apertures 35 as evident from FIG. 2.

Figure 3:
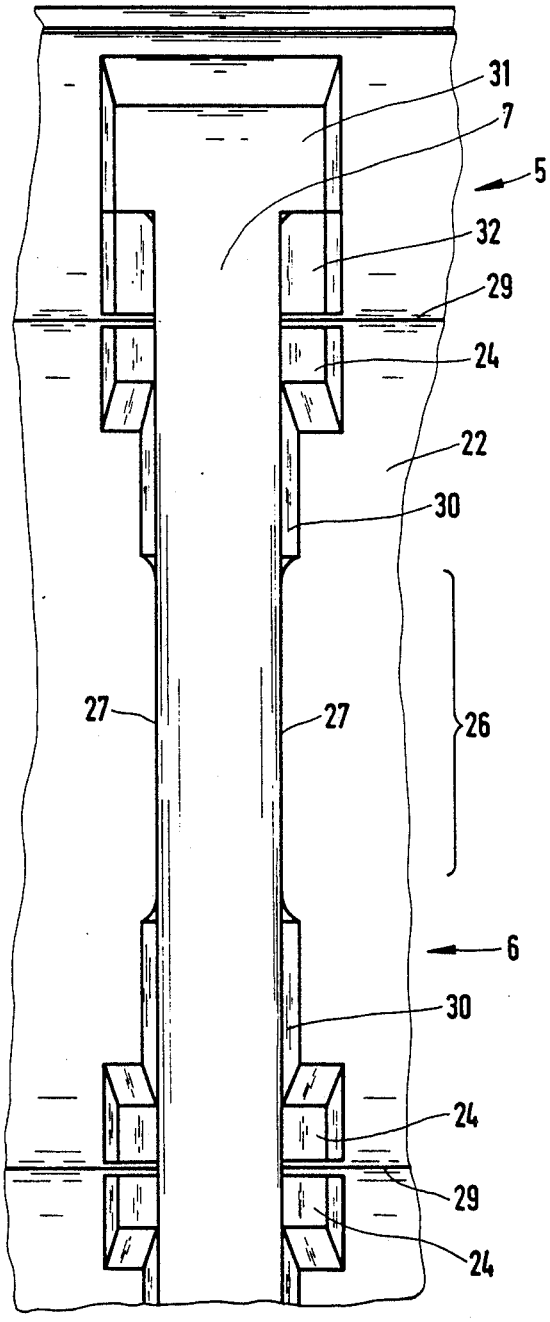
FIG. 3 is a front elevational view at the top of the heat exchanger showing a portion of the duct section and associated tension bar.

It is within the scope of the invention to provide the construction in FIG. 3 at both ends of the ducts or the construction in FIG. 4 at both ends of the ducts. Preferably, however, the tension bars are formed at one end as shown in FIG. 3 and at the other end as shown in FIG. 4 so that at one end the tension bars bear at one end against shoulders 32 and at the other end are threadably engaged by bolts/bearing against the end section.

By virtue of the bolts 34, the tension in the tension bars and consequently the compression force clamping the duct sections together can be adjusted. To this extent, the spacer plates 13 can be relatively compressible to allow elongation of the tension bars.

The tension bars 7, 8 conform in shape to the inner surface of the wall of the duct sections and extend along the inner surface in solid regions thereof devoid of apertures 35 as shown in FIG. 2.

Although the invention has been described in connection with specific embodiments thereof, it will become obvious to those skilled in the art that numerous modifications and variations can be made within the scope and spirit of the invention as defined in the attached claims.

What is claimed is:

1. A heat exchanger comprising two manifold ducts, a plurality of heat exchange tubes connected to said ducts for conveying fluid therebetween, said ducts each including a plurality of duct sections arranged axially one after the other in detachable abutting relation and tension bars extending within each duct and applying force to the duct sections to press the duct sections against one another in sealed relation and heat insulation means on said tension bars for insulating the tension bars from the interior of the ducts.

2. A heat exchanger as claimed in claim 1 wherein each duct has an inner surface, said tension bars extending at said inner surface of the duct.

3. A heat exchanger as claimed in claim 2 wherein s a i d inner surface of said duct is curved and said tension bars are curved in conformance therewith.

4. A heat exchanger as claimed in claim 3 wherein said duct sections have perforate regions provided with apertures in which said heat exchange tubes are engaged and solid regions without apertures between the perforate regions, said tension bars being disposed at said solid regions.

5. A heat exchanger as claimed in claim 1 wherein said heat insulation means comprises a heat insulation layer on said tension bars convering the same.

6. A heat exchanger as claimed in claim 1 wherein said heat insulation means comprises a shield plate covering said tension bars.

7. A heat exchanger as claimed in claim 1 further comprising tensioning means including threaded bolts between the ducts and the tension bars for applying tension to said bars.

8. A heat exchanger as claimed in claim 7 wherein said threaded bolts are accessible from outside the ducts.

9. A heat exchanger as claimed in claim 8 comprising end covers at each of the ends of the ducts said bolts engaging one of said end covers and said tension bars, and further comprising means for distributing tension force between said one end cover and the tension bars as said bolts are tightened.

10. A heat exchanger as claimed in claim 9 wherein said means for distributing the tension force comprises a spacer element inserted between said one end cover and the tension bars.

11. A heat exchanger as claimed in claim 1 wherein each duct includes spaced shoulders between which said tension bars extend and are restrained from angular movement relative to said duct sections.

12. A heat exchanger as claimed in claim 11 wherein each said tension bar includes lateral shoulders which abut against said spaced shoulders of the duct.

13. A heat exchanger as claimed in claim 12 wherein said lateral shoulders of the tension bar bear against the opposed shoulders of an end most duct section.

14. A method of assembling a heat exchanger comprising arranging in axial succession a plurality of sections each including a pair of manifold duct elements connected by a plurality of heat exchange tubes and pressing the manifold duct elements of the adjoining sections together in detachable sealed relation by applying compressive forces to the duct elements by a plurality of tension member extending longitudinally through the sections symmetrically at the inside surface of the duct elements and locking the duct elements of the adjacent sections against relative angular movement by said tension members.

15. A method as claimed in claim 14 comprising applying tension to the tension members from outside the duct elements to apply compressive forces to press the duct elements together.

16. A method of assembling a heat exchanger comprising arranging in axial succession a plurality of sections each including a pair of manifold duct elements connected by a plurality of heat exchange tubes and pressing the manifold duct elements of the adjoining sections together in detachable sealed relation by applying compressive forces to the duct elements by a tension member extending longitudinally through the sections at the inside surface of the duct elements and heat insulating the tension members from the interior of the duct elements.

17. A method as claimed in claim 16 comprising applying tension to the tension members from outside the duct elements to apply compressive forces to press the duct elements together.

* * * * *